US005531053A

United States Patent [19]

Hamm

[11] Patent Number: 5,531,053

[45] Date of Patent: Jul. 2, 1996

[54] SPRING FASTENER FOR HOLDING INSULATION AGAINST AN INNER SURFACE OF CAVITY WALLING

[76] Inventor: Hans Hamm, 1 Paisley Ct., Shanty Bay, Ontario, Canada, L0L 2L0

[21] Appl. No.: 260,220

[22] Filed: Jun. 14, 1994

[51] Int. Cl.[6] ..... E04B 1/38; E04B 1/74

[52] U.S. Cl. ..... 52/713; 52/404.5; 52/405.1; 52/561

[58] Field of Search ..... 52/712, 713, 309.14, 52/404.1, 404.2, 405.1, 410, 390.11, 378, 379, 217, 204.56, 404.5, 407.4; 254/104

[56] References Cited

U.S. PATENT DOCUMENTS

| | | | |
|---|---|---|---|
| 3,338,555 | 8/1967 | Williams | 254/104 |
| 3,730,476 | 5/1973 | Prichard, Jr. | 52/426 |
| 4,869,038 | 9/1989 | Catani | 52/713 |
| 5,207,043 | 5/1993 | McGee et al. | 52/713 |
| 5,351,456 | 10/1994 | Paine, Jr. | 52/426 |

*Primary Examiner*—Michael Safavi
*Attorney, Agent, or Firm*—Jane Parsons

[57] ABSTRACT

A spring clip fastener for pressing into the cavity of cavity walling to hold insulation firmly in place comprises a rigid plate having at least one spring strip bowed from its plane. The bowed spring strip or strips bias the insulation within the cavity against one of the walls. Each bowed strip has a groove across it to engage a horizontal restraining bar which may be provided by a tie between the walls of the cavity walling. When the restraining bar in engaged it is difficult for the fastener to slip out of position.

12 Claims, 2 Drawing Sheets

SPRING FASTENER FOR HOLDING INSULATION AGAINST AN INNER SURFACE OF CAVITY WALLING

BACKGROUND OF THE INVENTION

1. Field of the Invention

This invention relates to spring fastening clips for holding one sheet of material against a rigid wall or floor. In particular, the invention relates to spring fastening clips for use in holding insulation against one concrete block or brick wall in the cavity of cavity walling.

2. Acknowledgement of Prior Art

It is quite frequent to insert wire fittings between the courses of blocks in order to project from them. The fittings may be tie rods to tie the wall to another structure, for example, another wall as in cavity walls or to provide a restraining bar spaced from the wall surface for restraining other articles or wall fittings against the wall. These other articles may be sheet insulation, tar paper, plastic sheeting, etc. Very often the other article is sheet insulation.

The restraining bars themselves may be integral with tie cross rods or may be separate fittings. In any event, when a restraining bar is used, a problem exists in locating it to overlap the edge of the sheet which it is to restrain and to bias the sheet against the appropriate concrete block wall. All too often the restraining bars only hold the insulation loosely and less effectively.

Therefore, in laying sheet insulation against a concrete block wall it may be necessary to provide some means additional to the restraining bars or edging projecting downwardly to anchor the edges of the insulation sheet firmly against the concrete block wall.

One such means is a wedge which may be knocked into position between the restraining bar and the insulation to hold it very firmly against the wall. These wedges have a serrated surface intended to lie against a restraining bar to provide an extra anchor with the restraining bar. They may also be of a V-configuration to fit over any cross rods. These wedges may be molded in bulk and utilized during the building of the wall or afterwards where any restraining bar occurs. These wedges, however, since they have a serrated edge adjacent to the restraining bar may be difficult to knock into position and there is a danger of breaking the teeth of the wedge into sharp fragments which may cause danger to the operator.

Moreover, the saw tooth projections are arranged in straight lines across the wedge and do not allow for any off-straight restraint bars.

The present inventor has addressed the problems arising out of the use of wedges having saw tooth serrations on the side facing the restraining bar.

SUMMARY OF THE INVENTION

According to the invention, there is provided a spring clip fastener for insertion between a restraint and a wall to hold sheet material firmly against the wall, the fastener comprising a front, flat, generally rigid plate; a generally rigid top surface extending rearwardly from said plate to accept driving force directing the plate into a space between a restraint and sheet material to be biased against the wall; biasing means comprising a number of resilient strips each forming a resilient bow directed rearwardly from the plane of said plate, the bow being located to extend from an upper portion of said plate to a lower portion of said plate, and at least a lower portion of said bow merging with a lower portion of said plate through an acute angle; and at least one groove being provided in the bow to engage said restraint.

The restraint is suitably a restraining bar for example, a restraining bar provided in a tie between two walls of a double wall cavity wall. Alternatively the restraint could be the second wall of the cavity wall. The sheet material is normally sheet insulation.

The front plate may be made out of any suitable material which will have sufficient rigidity to be driven between the restraint and the insulation to be fastened against the wall. Thus, the plate may be made from metal such as steel, rigid plastics material such as nylon, polypropylene, etc. Of course, when the plate is made of plastics material, or indeed of any material, it must be of sufficient thickness to achieve the necessary rigidity. Conveniently for practical purposes, the resilient bow biasing means are of the same material as that of the plate although theoretically this is not necessary. The resilience may be achieved through the shape of the bowing and possibly through a difference in thickness in material. It is quite possible to envisage a spring clip fastener comprising a front plate of cast steel and biasing means comprising bowed steel springs although such a fastener might be expensive. Conveniently, the entire fastener may be injection molded from a material such as nylon.

Conveniently two bowed biasing means may be provided on each plate. Each biasing means may comprise a bowed strip extending rearwardly and upwardly from a lower edge of the plate. Thus, each bowed strip extends from a lower end thereof to extend rearwardly from the plate at an acute angle along an inclined ramp and, at its upper end may curve back abruptly to meet the plate generally at right angles. Thus the actual profile of the bowed strip may be that of a positive inclined ramp rising from the lower edge of the plate decaying exponentially to end in an upper part of the plate.

The fastener may be integrally formed of a single plastics material such as nylon, polypropylene or reinforced plastics materials. It may be formed by injection molding techniques. In this case it may be convenient to form the bowed biasing means with open slots in the plate to the rear of them. This allows convenience of mold design, and when the fastener is to be used in very narrow spaces allows the bowed biasing means to be deformed sufficiently to actually project forwardly of the plate to press into such as insulation on its forward surface.

The bowed biasing means may be parallel to one another and may have at least one horizontal recess to engage a restraining bar so the fastener does not slip. Due to the fact that the recess is provided in a resilient strip acting as a spring, there may be a degree of flexibility which may help to accommodate off-straight restraint bars.

Preferably, more than one horizontal recess is provided along the length of the bow as it rises along the inclined ramp. Thus it is possible to position the fastener firmly with respect to a restraint bar for different thicknesses of the sheet material such as insulation which is to be held against the wall. The horizontal recesses may be shaped such that their upper parts form stop ledges to engage the restraint bar. If it is desired to drive the fastener more deeply into the cavity to hold thinner insulation, the bow may be compressed to bypass some of the stop ledges. The uppermost recess may be provided with an upstanding stop to guard against driving the fastener too deeply so that the restraint bar slips over the top part of the bow.

BRIEF DESCRIPTION OF THE DRAWINGS

An embodiment of the invention will now be described by way of example with reference to the drawings, in which.

DETAILED DESCRIPTION OF PREFERRED EMBODIMENTS

Figure 1:
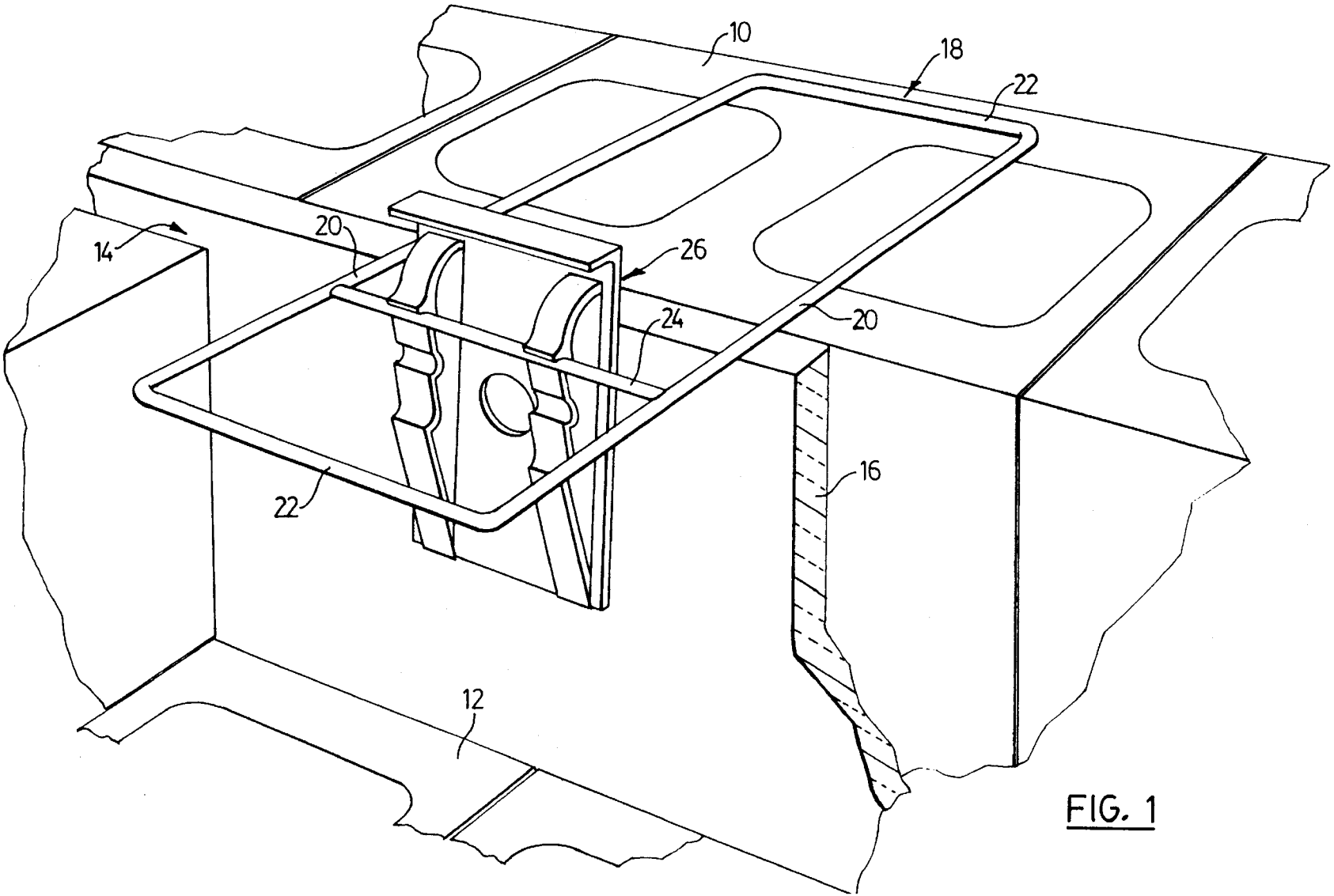
FIG. 1 shows a fastener according to the invention acting to hold sheet insulation in place in a cavity wall.

FIG. 1 shows a double wall cavity wall having a first wall 10 and a second wall 12 separated by a space 14 in which there is located a sheet of rigid insulation 16 such as foamed polystyrene. A tie 18 comprises a rectangular wire frame having parallel tie wires 20 extending between the walls 10,12 and parallel wires 22 located between courses of concrete blocks or bricks. A further restraint wire 24 parallel with wires 22 is located to lie in the space 14. When the next course of blocks is set the bars 22 of the tie 18 will be set in the cement between the courses.

When the walls 10,12 are of a height corresponding to the height of the top edge of insulation 16 a tie 18 may be set. If additional ties are required where convenient edges of the insulation do not occur the insulation may be punctured to accommodate them.

When the tie 18 is in the position shown in FIG. 1 with wires 22 overlying the walls 10,12, a fastener 25 according to the invention may be inserted to hold the insulation 16 firmly in place against the wall 10. The fastener 25 comprises a front plate 26 and two parallel bowed resilient strips 28.

From a top edge of plate 26 a driving surface 30 extends rearwardly. The plate 26 and the driving surface 30 are at least sufficiently rigid so that the plate may be forced into a narrow gap by pressure on the driving surface. For example, a hammer may be used to hammer the plate into position by hitting the driving surface 30. The driving surface 30 may be a narrow ledge extending over the whole width of the top edge of the plate 26 or it need not extend over the whole length of this top edge. It is only necessary that the driving surface 30 should present sufficient surface for the application of driving force.

The resilient strips 28 arise from the ends of slots 32 which lie parallel to each other and orthogonal to the top edge of plate 26 and driving surface 30. The upper end 34 of each slot 32 is spaced downwardly from driving surface 30 so that the thickest part of the fastener is spaced downwardly from driving surface 30. The lower end of each slot 32 is spaced slightly upwardly from the bottom edge 34 of plate 26 to allow an initial entry of the thin lower edge of the fastener.

The bowed strips 28 may be of any convenient shape but, as illustrated, they are shaped so that their profile comprises an inclined ramp arising from the lower end of respective slot 32 rising to the desired widest part of the bow. Thereafter, the profile decays exponentially to the upper end of respective slot 32. Thus, the strip profile presents a narrow lower portion which regularly increases in thickness to its widest point. In practice, when the fastener is driven into a narrow gap the bowed resilient strips 28 deform to flatten against plates 26. If the gap is very narrow and irregular it is possible for part of strips 28 to actually project forwardly through respective slot 32 to accommodate any roughness in the gap.

It should, of course, be appreciated that the provision of slots 32, while providing means to accommodate roughness in narrow gaps into which the fasyener may be driven, allow for deformation of the strips beyond the front surface of plate 26 to accommodate other awkwardly shaped gaps. The provision of slots 32 also allows the unitary construction of the fastener by means of injection molding when the material of the fastener is suitable for that purpose, for example, a plastics material such as nylon, polypropylene and other plastics material. It is possible to devise a unitary mold for a single molding operation when slots 32 are present. Moreover, if desired, it is also possible to provide a unitary mold for the molding of fasteners provided with slot 32 in which the bowed resilient strips 28 may have a different thickness to that of the plate 26. It is possible to envisage a situation where only light bias of the biasing strips within the narrow gap into which it is driven is required. In this case the resilience of the strips may be adjusted during manufacture by making them a different thickness.

Figure 3:
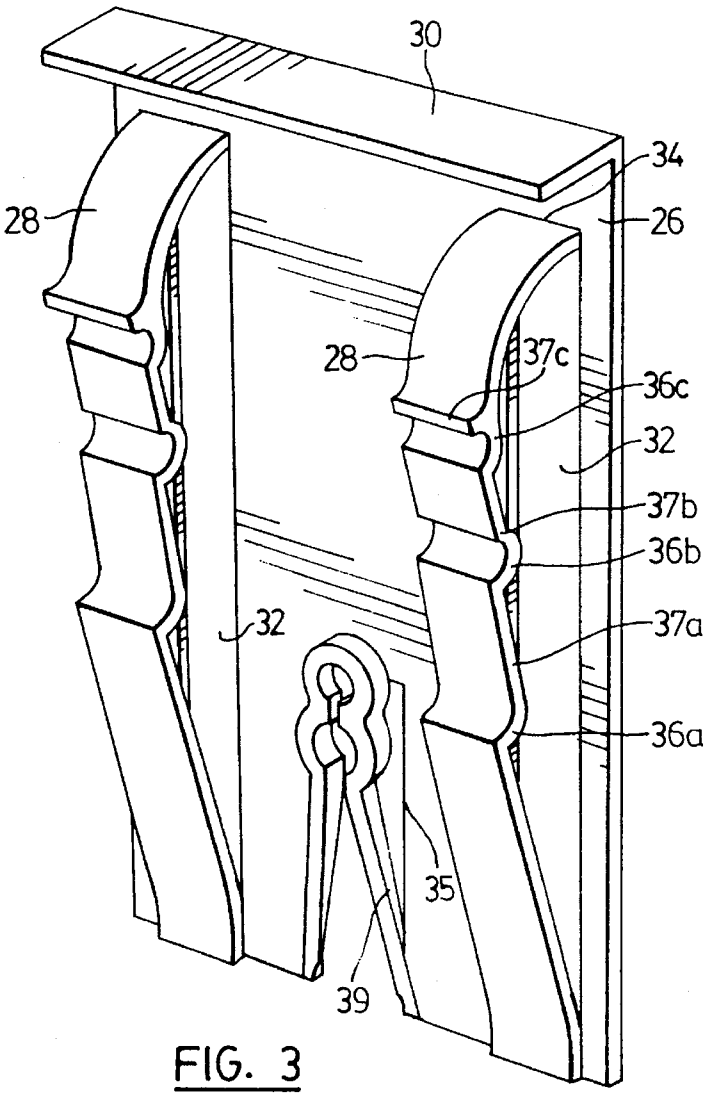
FIG. 3 shows an embodiment of another fastener according to the invention.
Figure 2:
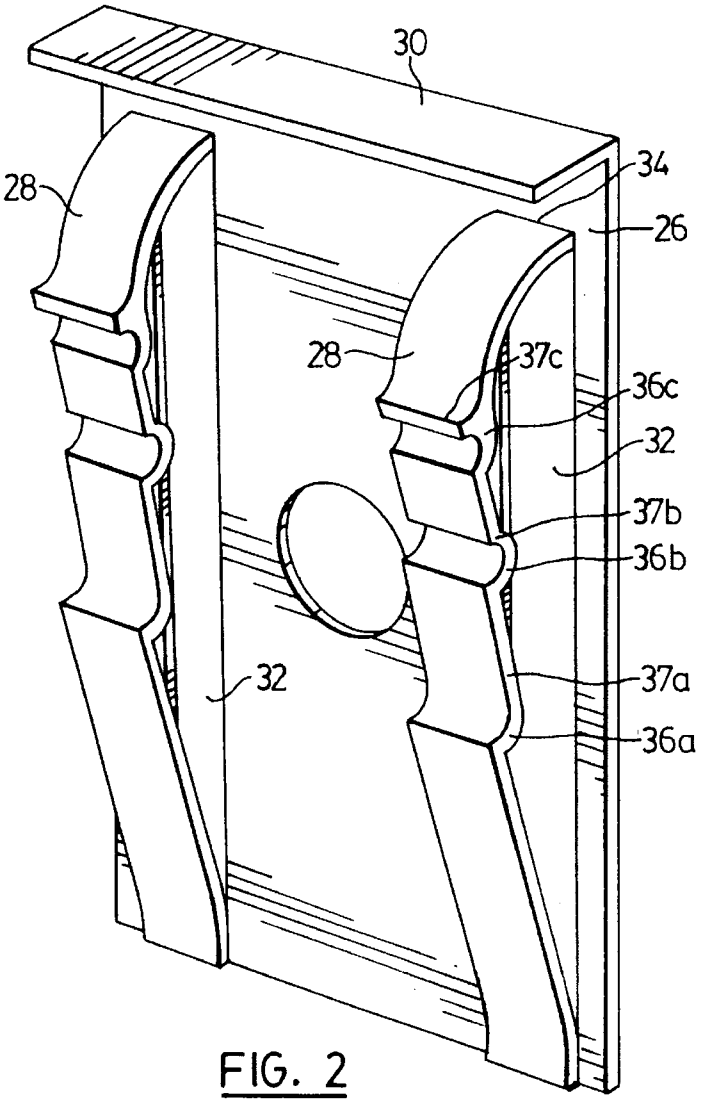
FIG. 2 is an enlarged view of the fastener of FIG. 1.

As illustrated in FIGS. 1 to 3 two resilient biasing strips 28 are provided extending between the ends of parallel slots 32. It will, however, be appreciated that a single wide strip is possible or a greater number of strips may also be used. The provision of two resilient biasing strips 28, or indeed any even number of resilient biasing strips 28, allows for the provision of a fastener as shown in FIG. 3.

The fastener in FIG. 3 differs from that of FIGS. 1 and 2 by the provision in plate 26 of a deep narrow U- or V-slot 35. This V-slot 35 is provided with a keyhole shaped spring clip 39. The keyhole has a generally circular upper portion shaped to accepted the pin of a key. This upper portion will be referred to as a "pine hole". The keyhole also has a generally wedge shaped lower portion shaped to accept the web of a key. The apex of the keyhole is attached to the apex of the U or V slot 35. Legs of the spring clip 39 extending from the apex of the keyhole are attached at their ends to the open end of U or V slot 35. The spring clip 37 stands slightly proud of the front plate 26. The provision of spring clip allows the fastener to be used across a tie rod projecting from a concrete block wall 10 to tie it with the other wall 12. The keyhole of spring clip 37 may have two substantially circular portions 39 for different positioning of fastener 25.

Latching means are provided on fasteners according to the present invention so that they may latch with restraining bars, such as bar 24 shown in FIG. 1, to guard against upward slipping of the fastener and resultant loosening of the sheet material such as the insulation which it is to hold against wall 10. The latching means may comprise forwardly indented grooves 36 extending across the width of resilient biasing strips 28 to engage with the restraint bar 24. The grooves 36 may be shaped to a general configuration intended to latch around part of the periphery of restraint bars which are conventionally used. Most importantly, the upper part of each groove 37 forms a stop to latch against restraining bar 24. In practice, as the fastener is driven into the space between the restraining bar 24 and insulation 16 the bowed resilient strips 28 are deformed towards the plane of the plate 26. When the restraining bar 24 is level with the groove 36, the bowed strip 28 springs back to lodge bar 24 in groove 36. Only if the space 14 is wide enough is it possible to compress the bowed strip 28 further and drive the fastener more deeply into the space. Such notches 36 may be integrally molded with the resilient strips when the fastener is made of plastics materials. However, when the fastener is made of other materials and the resilient strips may be, for example, spring steel, it may be necessary to form the grooves by metal forming techniques.

In the embodiment shown, in which two bowed resilient strips are illustrated, the resilience of the bowed strips may allow for a slight amount of tilting of grooves 36 from the horizontal. Thus, it may be possible that, by tilting of grooves 36, a slightly off-straight restraint bar may be accommodated.

Conveniently, as shown, more than one groove 36 is provided on each strip 28 at different distances along its length and hence at different distances from a rear surface of plate 26. Thus, when the fastener is driven into a gap between wall 12 and insulation, the restraining bar 24 will be engaged by groove 36A when the insulation is very thick 36B when it is thicker. Groove 36C may only engage bar 24 when very thick, high grade insulation is used. Again, it is to be noted that the number of grooves 36 which are provided is a matter of choice and all these notches may be molded in a single integral molding operation with strips 28 when the fastener is formed of plastics material.

As the bowed strip 28 is not so strongly deformed in this case, it is thought desirable to accentuate the upper stop surface with a defined edge, to guard against accidental disengagement of restraint bar 24 from the groove 36B.

When the restraint bar 24 engages the highest groove 36C, deformation of the bow is even less. In this case an actual upstanding stop 37C is provided.

It is to be understood that the shapes of the grooves 36 may be freely chosen to engage restraint bar 24. To an extent the shape of the groove is dependent. It will be noted that the grooves 36A, 36B and 36C are all of slightly different shapes.

Groove 36A has no defined upper edge. When, the fastener is used with thin insulation 16 so that groove 36A is engaged by restraining bar 24, the base of groove 36 will lie almost flush with plate 26. The upper part of groove 36 will rise sharply rearwardly from plate 26 forming an adequate stop. If it is desired to drive plate 26 more deeply there is no sharp barrier to be overcome.

Groove 36B, however, is provided with a sharp upper edge 37B upon the steepness of the ramp of the bow. In any event, the shape of each groove 36 should provide for a stop surface to engage the restraint bar 24.

I claim:

1. A spring clip fastener for insertion between a restraining bar and a wall to hold sheet material firmly against the wall, the fastener comprising a front flat generally rigid plate;

a generally rigid top surface extending rearwardly from said plate to accept driving force directing the plate into a space between a restraint and sheet material to be biased against a wall;

biasing means comprising a number of resilient strips, each of which forms a resilient bow directed rearwardly from the plane of said plate, the bow being located to extend from an upper portion of said plate to a lower portion of said plate at least a lower portion of said bow merging with the lower portion of said plate through an acute angle; and at least one horizontal groove being provided in the bow to engage said restraint.

2. A spring clip as claimed in claim 1 in which each of said strips is bowed from opposite ends of a slot through said plate.

3. A spring clip as claimed in claim 1 in which each of said strips has the profile of an inclined ramp rising from a lower portion of said plate and thereafter descending along an exponential slope to end in an upper part of said plate.

4. A spring clip fastener as claimed in claim 1 in which the number of said strips is two and they are parallel to each other.

5. A spring clip fastener as claimed in claim 1 formed of resilient plastics material.

6. A spring clip fastener as claimed in claim 1 in which each of said strips is provided with a horizontal groove to engage said restraining bar.

7. A spring clip fastener as claimed in claim 6 in which each of said strips is provided with a plurality of horizontal grooves to engage said restraining bar at different distances from said wall.

8. A spring clip fastener as claimed in claim 7 in which a stop for the restraining bar is provided for at least one of said grooves projecting rearwardly from the respective resilient strip.

9. A spring clip fastener as claimed in claim 8 in which said at least one of said grooves is that groove which is spaced furthest from said plate with respect to other said horizontal grooves.

10. A spring clip fastener as claimed in claim 1 in which the front flat generally rigid plate has an elongate slot through it extending upwardly from a lower edge and a keyhole shaped spring clip extends upwardly from to be substantially coextensive with said elongate slot, lower ends of the keyhole spring clip being fixed to lower side edges of said elongate slot, whereby a tie wire of the wall is holdable in a pin hole of the keyhole spring clip.

11. A spring clip fastener as claimed in claim 10 in which the keyhole spring clip has more than one pin hole aligned one above the other, whereby a tie wire of the wall is holdable in one or another of the pin holes dependent on the position of said fastener.

12. A spring clip fastener for use in fastening insulation within a cavity of a cavity wall to lie against one of the outer walls thereof, comprising:

a front flat generally rigid plate;

a generally rigid top surface extending rearwardly from said plate to accept driving force directing the plate into the cavity between the outer walls so that a front surface of said plate abuts said insulation;

biasing means comprising a number of resilient strips, each of which strips forms a resilient bow directed rearwardly from the plane of said plate, the bow being located to extend from an upper portion of the plate to a lower portion of the plate, and at least a lower portion of the bow merging with the lower portion of the plate through an acute angle;

at least one horizontal groove being provided in the bow to engage a horizontal restraining bar in said cavity.

* * * * *